United States Patent [19]

Peachey

[11] 4,060,705

[45] Nov. 29, 1977

[54] PRESSURE ACTUATED CONTINUOUS SWITCH

[75] Inventor: Cyril John Peachey, Crawley, England

[73] Assignees: Cyril John Peachey; Gwendoline Nora Peachey, both of Crawley, England

[21] Appl. No.: 674,313

[22] Filed: Apr. 7, 1976

[30] Foreign Application Priority Data

Apr. 9, 1975 United Kingdom ..... 14639/75

[51] Int. Cl.[2] ..... H01H 3/14; H01H 9/54

[52] U.S. Cl. ..... 200/153 M; 200/153 C; 200/153 S; 200/86 R

[58] Field of Search ..... 200/86 R, 86 A, 86.5, 200/61.19, 239, 153 C, 153 M, 153 S, 264, 275, 268, 278; 338/154; 340/272

[56] References Cited

U.S. PATENT DOCUMENTS

| | | | |
|---|---|---|---|
| 2,132,685 | 10/1938 | Hampton | 200/86 R |
| 2,799,756 | 7/1957 | Graham | 338/154 |
| 3,509,360 | 4/1970 | Miller | 307/119 |
| 3,732,384 | 5/1973 | Fischel | 200/86 R |
| 3,794,790 | 2/1974 | Leyland | 200/86 R |

FOREIGN PATENT DOCUMENTS

| | | | |
|---|---|---|---|
| 2,013,597 | 4/1970 | France | 335/205 |

*Primary Examiner*—Gerald P. Tolin
*Attorney, Agent, or Firm*—Wenderoth, Lind & Ponack

[57] ABSTRACT

A pressure actuated continuous switch in the form of a cable having two coaxial wires, which form the contacts of the switch, separated by a helically wound strip of insulating material. The pitch of the turns of the helical material determines the sensitivity of the switch. In a preferred form of the switch, a layer of semiconductive material is interposed between the insulating material and the other conductor.

9 Claims, 3 Drawing Figures

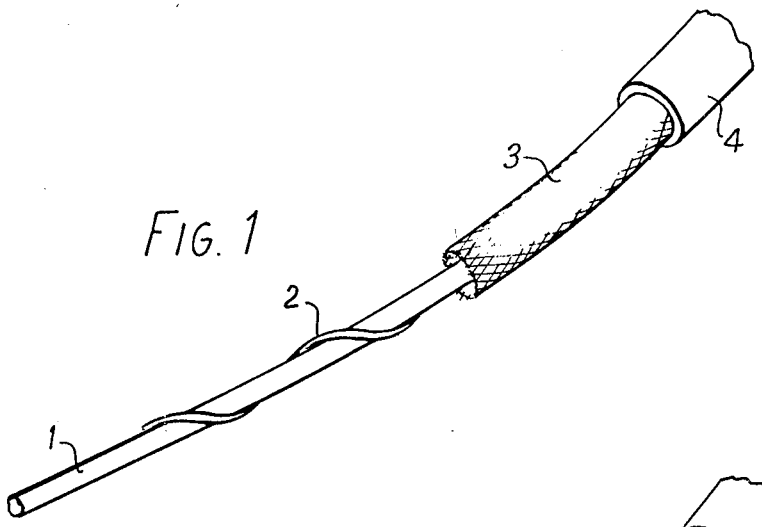
FIG. 1
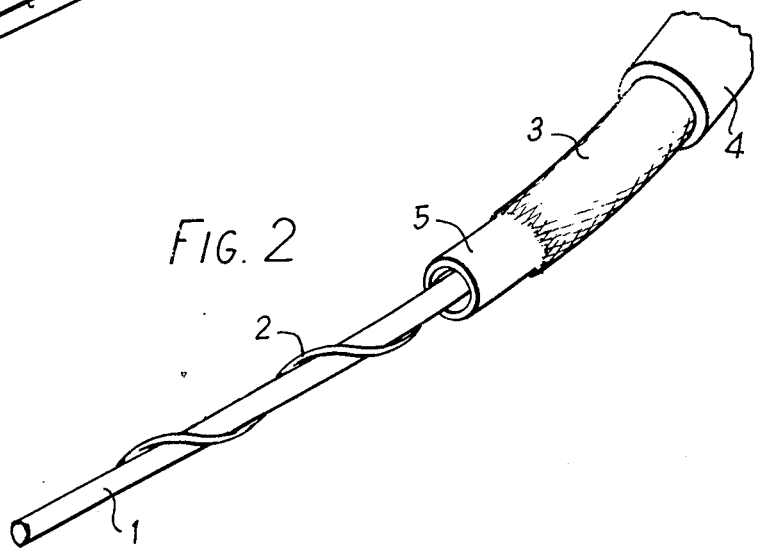
FIG. 2
FIG. 3
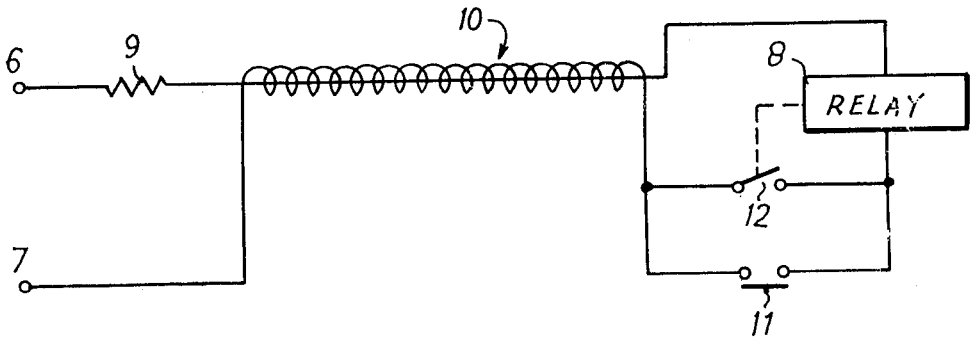

PRESSURE ACTUATED CONTINUOUS SWITCH

The present invention relates to pressure actuated continuous switches, by which is meant a switch of elongate form operable by pressure applied at substantially any place along its length.

According to the invention there is provided a pressure actuated continuous switch comprising a central conductor, a filament of insulating material helically wound around the central conductor, and a flexible tubular outer conductor coaxial with and surrounding the central conductor, the arrangement being such that the conductors are normally insulated from one another by the helically wound filament of insulating material, but make electrical contact when pressure is applied to the assembly.

The electrical contact may be by virtue of direct physical contact between the conductors. However, in a preferred embodiment of the invention a flexible sheath of semi-conductive material is interposed between the filament and the outer conductor. With this arrangement electrical contact between the conductors is established via the semi-conductive sheath when pressure is applied.

In use, means are provided for connecting the conductors to external circuitry so that the switch can be used to actuate such items as safety switching mechanisms, warning signals or detector circuitry, depending upon the particular application.

The outer conductor should be made of springy material and preferably both conductors are made of springy material, which return to their original shape after being bent, in order to prevent kinking and permanent short-circuits. Furthermore, the materials used for the conductors should preferably be resistant to corrosion. Suitable materials include hard copper, stainless steel, plated steel or phosphor bronze. Preferably the two conductors are made of the same material in order to prevent electrolytic action due to contact between dissimilar metals.

The filament may be made of polythene, nylon or P.V.C. If desired, the filament may be made of elastic material to further aid the elasticity of the whole structure. The outer conductor may take the form of a continuous sleeve, or be braided in a similar manner to the outer conductor of conventional coaxial cable. Alternatively, the outer conductor may be made from a strip of conductive material which is wound helically around the central conductor and insulating material in such a way that adjacent turns overlap. The central conductor may be solid, but preferably it is stranded in order to reduce the possibility of kinking which can cause the switch to become permanently short circuited.

Preferably the assembly is covered by a plastic sheath for protection purposes and to prevent the ingress of dirt and moisture.

In the preferred embodiment of the invention the provision of a semiconductor sheath interposed between the insulating filament and the outer conductor provides a mechanical support for the outer conductor during manufacture. The semi-conductive material may be a graphite loaded plastic material. Also, the use of such a sheath helps prevent short-circuits which might occur with a braided outer conductor. The individual wires of such braiding can break and the free ends could then bend to make accidental contact with the inner conductor. The semiconductive sheath prevents this.

The contact resistance, although increased by the introduction of a semi-conductive sheath is still low enough, typically less than 10 ohms, to be quite acceptable in most applications of the switch.

Such a semi-conductive sheath may be extruded on top of the insulating material during manufacture. Furthermore, the outer conductor may be formed by plating or spraying a conductive layer onto the semi-conductive sheath.

The sensitivity of the switch (i.e. the amount of pressure required to make an electrical contact) can be easily established during manufacture by selecting the pitch of the helically wound insulating material — the tighter the turns of the helix the lower the sensitivity. The sensitivity can be increased beyond that ordinarily obtainable by setting the pitch of the helix by overlying the outer conductor with additional filaments, preferably of insulating material. For example an additional filament helically wound over the outer conductor will increase sensitivity by concentrating the pressure applied over a relatively small area, thus increasing the effective force. A similar effect can be obtained by over-lying the assembly with a piece of rubber or similar material which is ribbed on the inside in a direction transverse to the length of the switch. The rubber is arranged to be the switch operating pad upon which pressure must be applied to operate the switch.

In order that the invention may be better understood, an embodiment thereof will now be described by way of example only and with reference to the accompanying drawings in which:

FIG. 1 is a perspective view of the basic components of a continuous switch in accordance with the present invention in which parts have been cut away to show the construction;

FIG. 2 is a view similar to FIG. 1 showing a switch according to a preferred embodiment of the invention; and FIG. 3 is a circuit diagram illustrating the use of the continuous switch in a typical safety or security system.

Referring to FIG. 1, the continuous switch comprises a central conductor 1 of hard copper around which is helically wound a thread 2 of insulating material, such as polythene. An outer conductor 3 of braided hard copper wires is formed as a sheath around the thread 2 and is normally spaced from the conductor 1 by virtue of the thread 2. A further sheath 4 of insulating material is formed around the conductor 3 for protection purposes. Means (not shown) are provided whereby the conductors 1 and 3 may be connected to external circuitry. Such connection means may take the form of wires or terminals or a coaxial-type plug or socket connected to one or both extremities of the switch. The switch is closed by causing the outer conductor 3 to be pressed inwards until contact is made with the inner conductor. Closure of the switch can be detected by external circuitry and used to actuate safety circuits, alarms, detectors, or other indicating equipment as appropriate.

FIG. 2 shows a switch similar to that of FIG. 1 the same reference numerals being employed as appropriate. In the switch of FIG. 2 a flexible sheath 5 of graphite-loaded plastic is interposed between the filament 2 and the outer conductor 3. The sheath 5 is formed by extrusion over the insulating filament during manufacture. Pressure applied to the switch deflects the sheath 5 to cause it to make contact with the inner conductor 1 and electrical contact is thereby established between the inner and outer conductors via sheath 5. The contact resistance caused by the sheath is less than 10 ohms, the sheath being of a semi-conductive nature. This contact resistance does not materially affect the operation of the circuit to which the switch is connected.

These switches can be made on conventional cable making machines and using known techniques. They find many diverse uses, a number of which will be mentioned below by way of example. The switch may be used in industrial safety systems to detect the abutment of surfaces to ensure, for example, that machinery cannot be started until a guard door has been shut, and incorporated into mats placed around dangerous machinery; in domestic and industrial security systems a length of the switch may be laid zig-zag under a carpet or other floor covering to detect the passage of an intruder. They may be used as a continuous alarm or bell actuator, for example in buses and trains, around the walls of a room for old people or bed ridden hospital patients, or for security purposes around the perimeter walls of a prison to detect escapes via rope ladders and to detect the approach of persons or vehicles to isolated compounds. The switch could also be wired along the passageways etc. of buildings in order to replace existing individual fire alarm switches. The continuous switch can be bent around fairly tight curves, without affecting its performance. It is anticipated that the maximum diameter of the switch, including the outer protective sheath, would be of the order of 5/32 inches and a minimum bend radius for this order of diameter would be about 1 inch. The switch can, of course, be made in any length, being limited only by the resistance of the conductors making up the switch.

Further applications of the switch include machine control wherein an identical switching function needs to be made from a number of different positions. The use of the above described switch saves the need for large numbers of parallel switches. The switch may also be mounted in coal mines and similar areas to facilitate signalling from any number of positions within the mine workings. The switch could be mounted on motorway crash barriers to signal the impact of vehicles thereon, for example to warn police or to actuate hazard warning lights. The switch could be mounted around the interior of aircraft cargo holds to detect the shifting of cargo during flight.

One typical safety switching application of the switch of this invention is illustrated in FIG. 3. In this system, a power supply unit supplies power to terminals 6 and 7 which are connected to a relay coil 8 via a current limiting resistor 9 and a continuous switch according to this invention, shown diagrammatically by reference number 10. In this case the external connections to the continuous switch are taken from respective extremities of the switch so that, in order to operate the relay, current has to pass through the switch. A push switch 11 is connected in parallel with a normally-off contact 12 of the relay so that the current supply to the relay coil is normally inhibited. Other contacts (not shown) of the relay can switch off dangerous machinery or operate alarm bells or other warning devices, as appropriate.

The circuit is brought into operation by closing the push switch 11 whereupon current is supplied to relay coil 8 to energise the same and close the contact 12. The push switch 11 is then released whereafter current is maintained through the relay coil by virtue of the contact 12. If the continuous switch 10 is now operated to short the two conductors, the current supply to relay coil 8 ceases, and the contact 12 opens. At this point the remaining contacts of the relay are actuated to operate safety, control or security circuits. Subsequent opening of the continuous switch 10, due to release of pressure thereon, does not inhibit the operation of such circuits since the contact 12 is now open, and remains so until the push switch 11 is once again operated to reset the circuit.

It will be seen that a similar situation occurs if, when the circuit is set for operation, one of the conductors of the continuous switch 10 is broken. This also has the effect of inhibiting the supply of current to the relay coil 8 which thus goes into the alarm condition. Thus a warning can be given should a fault develop in the continuous switch 10 or the wiring thereto, either accidentally or due to deliberate action.

I claim:

1. A pressure actuated continuous switch comprising a central conductor, a filament of insulating material helically wound around the central conductor with empty spaces between the turns of said filament, a braided flexible tubular outer conductor coaxial with and surrounding the central conductor, and a flexible sheath of semiconductive material interposed between the insulating material and the outer conductor, whereby the conductors are normally insulated from one another by the helically wound filament of insulating material, and when pressure is applied to the assembly, the conductors are deformed into at least one of said empty spaces and are electrically connected through said flexible sheath.

2. A switch as claimed in claim 1 wherein the semiconductive material is a graphite loaded plastic material.

3. A switch as claimed in claim 1 wherein the inner conductor is made of springy material.

4. A switch as claimed in claim 1 wherein the conductors are made of corrosion resistant material.

5. A switch as claimed in claim 1 wherein the two conductors are made of the same material.

6. A switch as claimed in claim 1 wherein the filament is made of elastic material.

7. A switch as claimed in claim 1 wherein the central conductor comprises a solid wire.

8. A switch as claimed in claim 1, wherein the outer conductor is covered externally by a sheath.

9. A switch as claimed in claim 8 wherein the sheath is made from plastics material.

* * * * *